US005667214A

United States Patent [19]

Belec et al.

[11] Patent Number: 5,667,214

[45] Date of Patent: Sep. 16, 1997

[54] ENVELOPE TURNING AND ALIGNING APPARATUS

[75] Inventors: Eric A. Belec, Southbury; Bryan L. Boggiano, Waterbury, both of Conn.

[73] Assignee: Pitney Bowes Inc., Stamford, Conn.

[21] Appl. No.: 529,947

[22] Filed: Sep. 15, 1995

[51] Int. Cl.[6] ..... B65H 5/00

[52] U.S. Cl. ..... 271/225; 271/251; 271/184; 271/185; 198/416

[58] Field of Search ..... 271/2, 225, 184, 271/185, 251; 198/416

[56] References Cited

U.S. PATENT DOCUMENTS 4,879,571 11/1989 Plasscheart ..... 271/225 X
5,137,506 8/1992 Haenel et al. ..... 271/225 X

FOREIGN PATENT DOCUMENTS 55-140450 11/1980 Japan ..... 271/225

*Primary Examiner*—David H. Bollinger
*Attorney, Agent, or Firm*—Christopher J. Capelli; Robert H. Whisker; Melvin J. Scolnick

[57] ABSTRACT

Apparatus for turning and aligning flat articles. The apparatus includes: a first conveyor for transporting flat articles horizontally from an upstream to a downstream position; a second conveyor oriented at an angle to the first conveyor, the second conveyor having an upstream and a downstream end, wherein the upstream end of the second conveyor is situated adjacent the downstream end of the first conveyor, and second conveyor is situated to receive the flat articles from the first conveyor; a pivoting device located on one side of the second conveyor for engaging a side of the flat articles; and a third conveyor having an upstream end located adjacent the downstream end of the second conveyor, the third conveyor having a flat deck, an angled roller extending just above the flat deck, a registration wall on one side of the flat deck, and a normal force sphere mounted above the angled roller, wherein the angled roller and the sphere drive the flat articles downstream and against the registration wall.

7 Claims, 3 Drawing Sheets

ENVELOPE TURNING AND ALIGNING APPARATUS

BACKGROUND OF THE INVENTION

The instant invention relates to apparatus for turning and aligning flat articles, and particularly to such apparatus for use with envelopes.

Turning devices for flat articles that are conveyed horizontally are required in inserting and mail processing systems. Examples of flat articles are envelopes, letters, postcards, endless forms issued by a computer controlled printing device that are cut into sheets from an endless web, and the like.

In an inserting and mail processing system, sheets of paper are fed one by one, or as a collation, to a folding machine and subsequently, with or without additional enclosures, are conveyed to an inserting machine where the sheets are inserted into an envelope. After insertion of the sheets into the envelope, the stuffed envelope is forwarded to a postage station where postage is imprinted thereon by a postage meter or other postage metering means. In some systems, it is necessary to turn the stuffed envelope through a 90 degree angle after the envelope has been stuffed and before the postage is applied. Usually the turn is required because the room containing the insertion and mail processing apparatus is not long enough to permit the stuffed envelope to continue along a straight path.

In order for postage to be applied to the stuffed envelope, it is necessary for the envelope to be aligned against a registration edge parallel to the direction of travel of the envelope. Prior art devices are known for turning and aligning envelopes. However, the prior art devices require a substantial distance in which to align the envelope after turning, typically on the order of at least three to four times the length of the envelope being aligned. The instant invention provides apparatus which can turn the envelope and then align the envelope with a minimal footprint, i.e. less than three times the length of the envelope, and provides superior reliability.

SUMMARY OF THE INVENTION

Accordingly, the instant invention provides apparatus for turning and aligning flat articles. The apparatus includes: a first conveyor for transporting flat articles horizontally from an upstream to a downstream position; a second conveyor oriented at an angle to the first conveyor, the second conveyor having an upstream and a downstream end, wherein the upstream end of the second conveyor is situated adjacent the downstream end of the first conveyor, and the second conveyor is situated to receive the flat articles from the first conveyor; a pivoting device located on one side of said second conveyor for engaging a side of the flat articles; and a third conveyor having an upstream end located adjacent the downstream end of the second conveyor, the third conveyor having a flat deck, an angled roller extending just above the flat deck, a registration wall on one side of the flat deck, and a normal force sphere mounted above the angled roller, wherein the angled roller and the sphere drive the flat articles downstream and against the registration wall.

DETAILED DESCRIPTION OF THE PREFERRED EMBODIMENT

Figure 1:
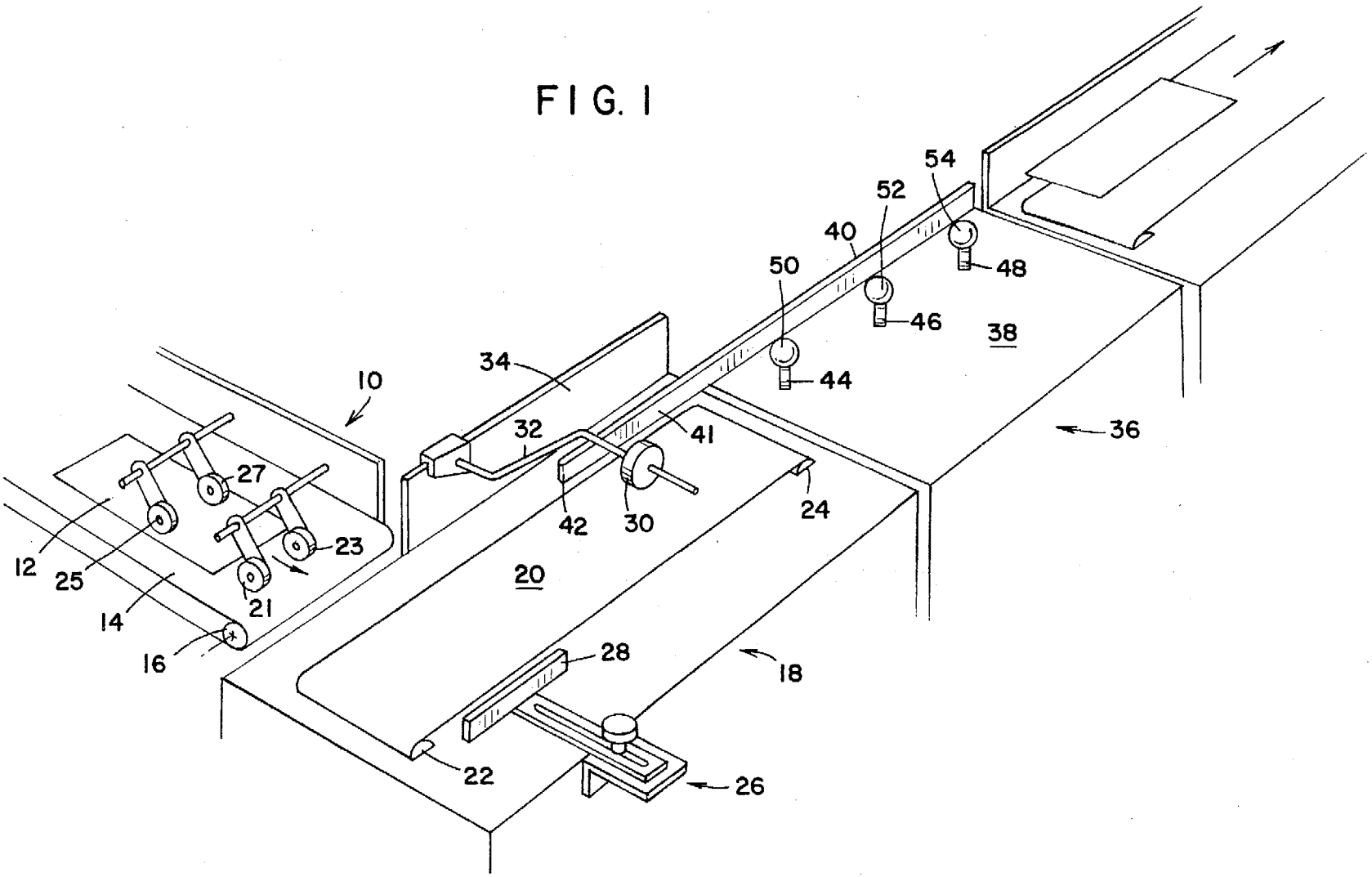
FIG. 1 is a perspective view of envelope turning apparatus in accordance with the instant invention.
Figures 2, 6:
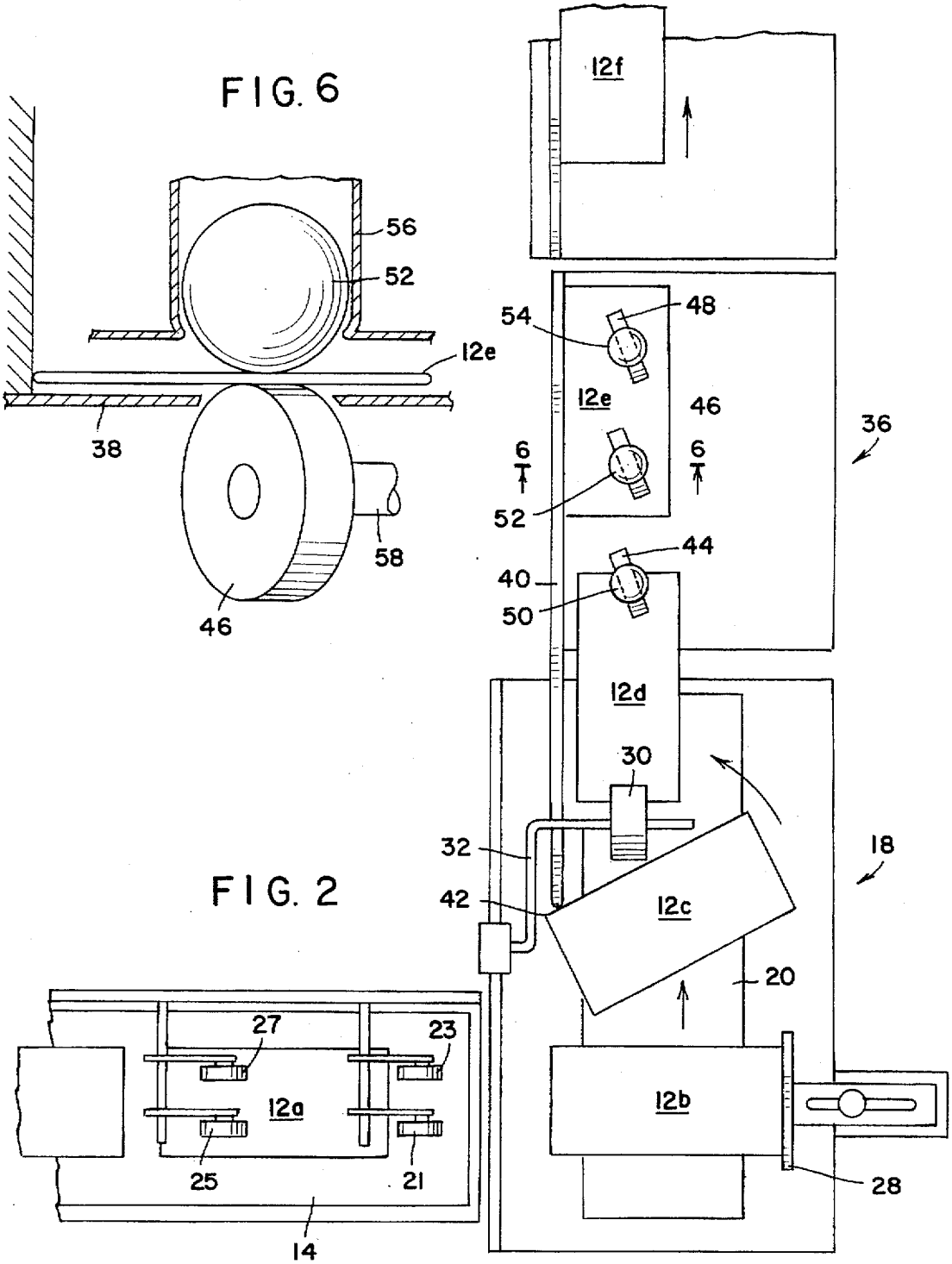
FIG. 2 is a top, plan view of the apparatus seen in FIG. 1 showing the various positions and alignments of the envelope before and after turning.
FIG. 6 is a sectional view taken on the plane indicated by the line 6—6 in FIG. 2.

In describing the preferred embodiment of the instant invention, reference is made to the drawings, wherein there is seen in FIGS. 1 and 2 a flat belt envelope transport generally designated 10 for transporting an envelope 12 lengthwise from upstream apparatus, typically an inserting machine (not shown). The first envelope transport 10 includes a flat belt 14 which is driven continuously and mounted on a pair of rollers 16 (only one is shown) and idler rollers. A first pair of idler rollers 21 and 23 and a second pair of idler rollers 25 and 27 cooperate with the belt 14 to transport the envelopes 12.

Downstream of the flat belt transport 10 is a second, flat belt transport 18 oriented perpendicular to the first transport 10. The second transport 18 includes a second, continuously running flat belt 20 mounted on a pair of rollers 22 and 24. The second belt 20 is located about ¼ to ½ inch below the first belt 14 so that an envelope 12 can be deposited onto the belt 20 by the belt 14. In-line with the transport 10 on the far side of the transport 18 is an adjustable envelope stop 26 having a stopping bar 28 oriented perpendicular to the direction of travel of the first transport belt 14.

The second transport 18 also includes an adjustable, idler turning roller 30 mounted on a supporting arm 32 extending from a sidewall 34 of the second transport 18. The turning roller 30 can be adjusted between upstream and downstream positions, and can be positioned at variable distances from the sidewall 34. Downstream of the second transport 18 is an aligning transport 36 having a flat deck 38 and a longitudinally extending registration wall 40 which includes, at its upstream end, arm 41 which extends over the second transport 18 and concludes with a rounded, pivot point 42 at its upstream end. The aligning transport 36 additionally includes three angled transport rollers 44, 46 and 48 the tops of which project just slightly above the flat deck 38 of the transport 36. Above the rollers 44, 46 and 48 are three normal force spheres 50, 52 and 54 mounted in sleeves 56 and secured to the registration wall 40 (see FIG. 6). The rollers 44, 46 and 48 are mounted on continuously driven shafts 58 which are mounted in suitable housing of the aligning transport 36 underneath the deck 38. The driven shafts 58 are rotated by conventional motor means not shown.

Figure 3:
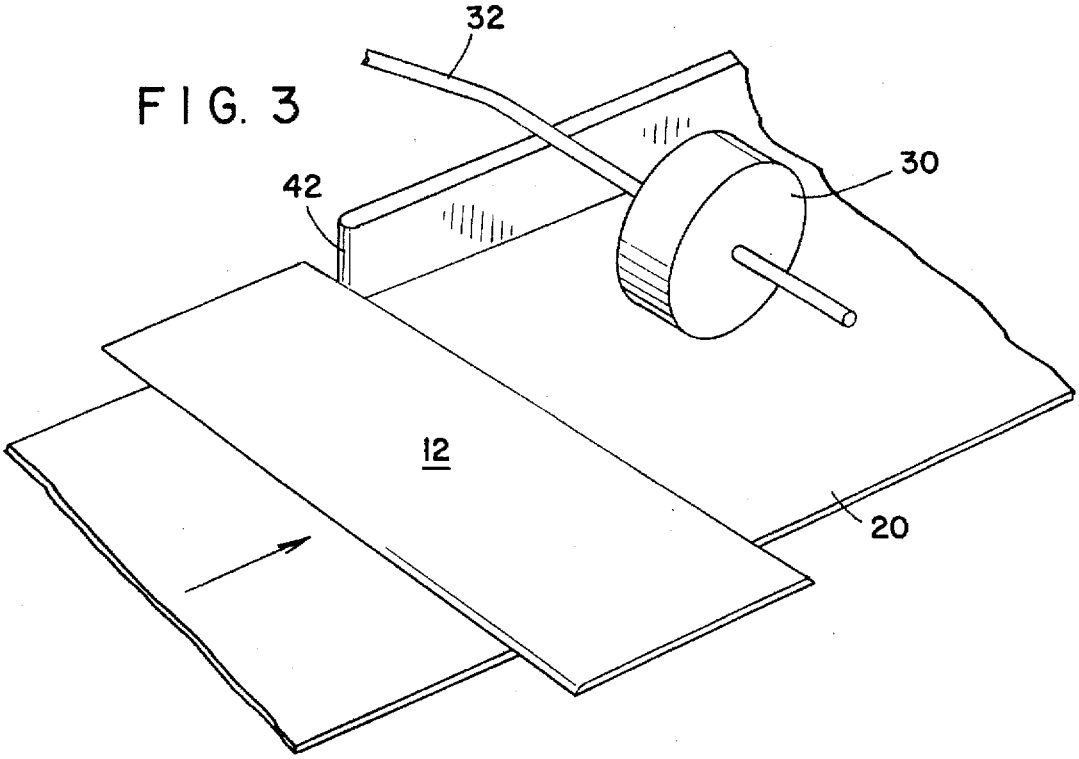
FIG. 3 is an enlarged, perspective view of the envelope just prior to its encountering the pivot point.
Figure 4:
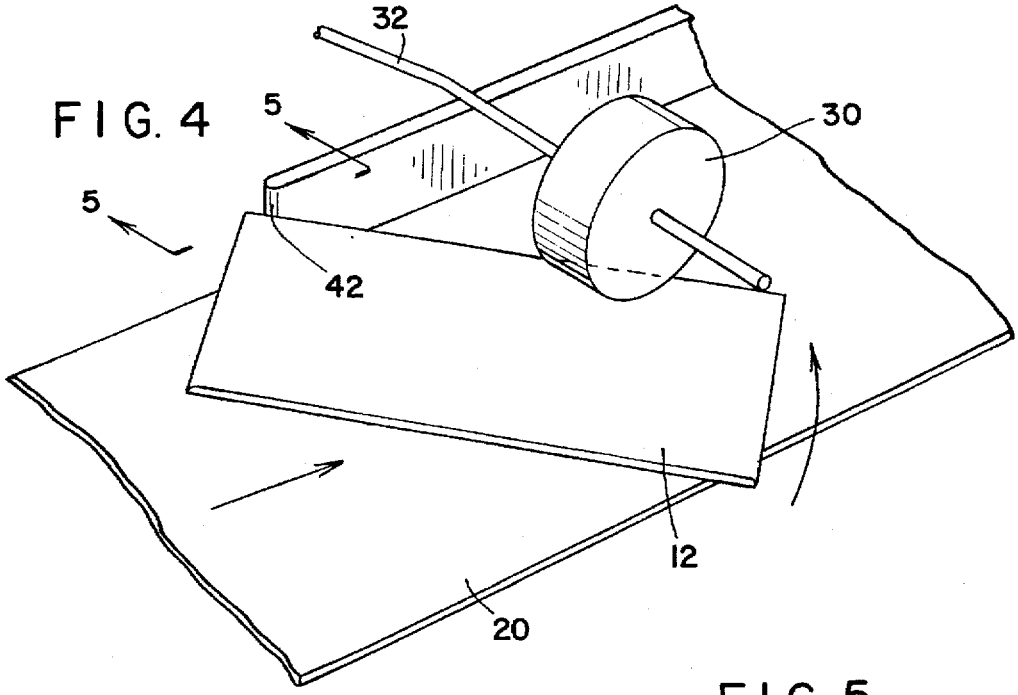
FIG. 4 is similar to FIG. 3 but shows the envelope just after it has engaged the pivot point.
Figure 5:
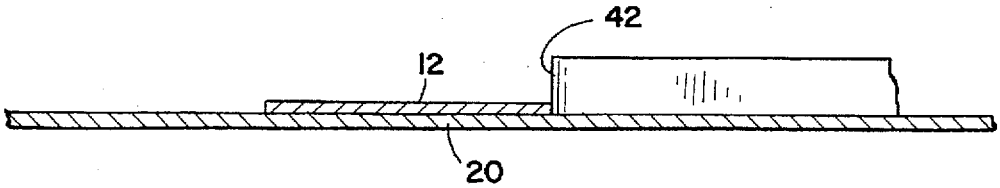
FIG. 5 is a sectional view taken on the plane indicated by the line 5—5 in FIG. 4.

The operation of the foregoing apparatus will now be described. A filled envelope **12*a* is carried from upstream apparatus, such as an envelope inserting machine (not shown) by the flat belt envelope transport 10 and dumped on the second transport 18. FIG. 2 shows six envelopes 12*a–f* in the various positions and alignments before and after turning. Envelope 12*b* shows the position after the envelope is deposited onto the second transport 18 and stopped by the envelope stopping bar 28. The envelope is then conveyed by the second belt 20 in a direction perpendicular to the direction of transport of the first belt 14 (see FIG. 3) until the envelope encounters the pivot point 42 of the arm 41, as represented by envelope 12*c* (see FIG. 4**). As the envelope 12*c* is conveyed downstream by the second belt 20, the pivot point 42 retards the left side of the envelope 12, resulting in the envelope 12*c* rotating counter-clockwise about the pivot point 42. The envelope 12*c* is then engaged by the turning roller 30 which helps to further convey the pivoted envelope 12*c* downstream toward the position of envelope 12*d*. The turning roller 30 assists in providing the rotary motion needed to turn the envelope and have it travel along its long axis.

After pivoting around the pivot point 42, the envelope will be traveling substantially parallel to the registration wall 40 as shown by envelope 12*d*. To ensure that the envelope becomes 100% registered along the registration wall 40, the envelope is transitioned from the conveyor belt 20 onto the aligning transport 36. The normal force spheres 50, 52 and 54 located above the angled transport rollers 44, 46 and 48 respectively provide sufficient force to reliably urge the envelope against the registration wall 40 and maintain the envelope transport motion to the end of the aligning transport 36, at which point the envelope can be accepted by any device that requires the envelope to be transported along a known line of registration. The envelope 12*e* shows the envelope 100% aligned against the registration wall, and the envelope 12*f* represents the envelope being conveyed further downstream, 100% aligned.

The angled transport rollers 44, 46 and 48 are shown as being oriented at an angle of about 25 degrees with respect to the registration wall 40. The angle of orientation may be varied depending on how quickly it is desired to drive the envelope against the registration wall 40. Although the preferred embodiment shows three transport rollers 44, 46 and 48, the instant invention can be made to function with only one angled transport roller.

The transport 10 is shown with a flat belt 14, and idler rollers 21, 23, 25 and 27, but the transport 10 can consist of various devices for moving envelopes, such as driven rollers on the bottom and idler rollers on top of the envelope, or dual belts (belts above and below the envelope).

The second transport 18 is shown as being oriented perpendicular to the first transport 10; however, these two transports 10 and 18 can be oriented relative to one another at virtually any angle.

It should be understood by those skilled in the art that various modifications may be made in the present invention without departing from the spirit and scope thereof, as described in the specification and defined in the appended claims.

What is claimed is:

1. Apparatus for turning and aligning flat articles, comprising:

a first conveyor for transporting flat articles horizontally from an upstream to a downstream position;

a second conveyor oriented at a 90 degree angle relative to said first conveyor, said second conveyor having an upstream and a downstream end, wherein said upstream end of said second conveyor is situated adjacent said downstream end of said first conveyor, said second conveyor situated to receive said flat articles from said first conveyor;

a pivoting device located on one side of said second conveyor for engaging a side of said flat articles; and a third conveyor having an upstream end located adjacent the downstream end of said second conveyor, said third conveyor having a flat deck, a first angled roller extending just above said flat deck, a registration wall on one side of said flat deck, and a normal force sphere mounted above said angled roller, wherein said angled roller and said sphere drive said flat articles downstream and against said registration wall and said registration wall extends along said second conveyor, and said pivoting device includes the upstream end of said registration wall.

2. The apparatus of claim 1, wherein the upstream end of said registration wall is rounded.

3. The apparatus of claim 2, wherein said first angled roller is oriented at an angle of about 25 degrees with respect to said registration wall.

4. The apparatus of claim 3, additionally comprising a second angled roller parallel to said first angled roller.

5. The apparatus of claim 1, additionally comprising means for stopping said flat articles emerging from said first conveyor.

6. The apparatus of claim 1, additionally comprising a stopping bar for stopping said flat articles emerging from said first conveyor.

7. The apparatus of claim 6, wherein said flat articles comprise filled envelopes.

* * * * *